US007311383B2

(12) United States Patent
Akahira et al.

(10) Patent No.: US 7,311,383 B2
(45) Date of Patent: Dec. 25, 2007

(54) LIQUID DISCHARGE RECORDING APPARATUS AND LIQUID DISCHARGE RECORDING METHOD

(75) Inventors: Makoto Akahira, Yokohama (JP); Satoshi Wada, Machida (JP); Yoshitomo Marumoto, Kawasaki (JP); Tsuyoshi Shibata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 505 days.

(21) Appl. No.: 11/085,126

(22) Filed: Mar. 22, 2005

(65) Prior Publication Data

US 2005/0212834 A1 Sep. 29, 2005

(30) Foreign Application Priority Data

Mar. 26, 2004 (JP) ..... 2004-092978

(51) Int. Cl.
*B41J 2/15* (2006.01)
*B41J 2/145* (2006.01)

(52) U.S. Cl. ..... 347/40; 347/41

(58) Field of Classification Search ..... 347/12, 347/13, 40–42, 44, 47, 56–59
See application file for complete search history.

(56) References Cited

U.S. PATENT DOCUMENTS 4,313,124 A 1/1982 Hara ..... 347/57
4,345,262 A 8/1982 Shirato et al. ..... 347/56
4,459,600 A 7/1984 Sato et al. ..... 347/47
4,463,359 A 7/1984 Ayata et al. ..... 347/56
4,558,333 A 12/1985 Sugitani et al. ..... 347/65
4,723,129 A 2/1988 Endo et al. ..... 347/56
4,740,796 A 4/1988 Endo et al. ..... 347/56
6,302,517 B1 * 10/2001 Kanaya ..... 347/41
2005/0212854 A1 9/2005 Akahira et al. ..... 347/44

FOREIGN PATENT DOCUMENTS

JP 59-123670 7/1984
JP 59-138461 8/1984

* cited by examiner

*Primary Examiner*—Juanita D. Stephens
(74) *Attorney, Agent, or Firm*—Fitzpatrick, Cella, Harper & Scinto

(57) ABSTRACT

The invention has an object to provide a liquid discharge recording method and a liquid discharge recording apparatus capable of outputting images at high speed with high quality and high reliability, and has a feature in that when adjacent overlapping dots are formed on a print material, the dots are formed with a dot placement time difference that may reduce uneven optical densities of the overlapping portion of the dots.

5 Claims, 11 Drawing Sheets

LIQUID DISCHARGE RECORDING APPARATUS AND LIQUID DISCHARGE RECORDING METHOD

BACKGROUND OF THE INVENTION

1. Field of the Invention

The present invention relates to a liquid discharge recording apparatus (an ink jet recording apparatus) and a liquid discharge recording method (an ink jet recording method) for recording by a liquid discharge recording system (an ink jet recording system) including discharging a liquid from a discharge port to form pixels on a print material and forming an image from the pixels.

2. Related Background Art

With the widespread use of information processing equipment such as a copier, a work processor or a computer, and communications equipment, an apparatus for recording digital images using a liquid discharge head (an ink jet head) has been rapidly widely used as an image forming apparatus or a recording apparatus for such equipment. There has been an increasing need for a recording apparatus adapted for high quality images and color images as information processing equipment and communications equipment have processed high quality or color visual information.

Such a recording apparatus has used a liquid discharge head having nozzles each including a discharge port of ink (a liquid) and a channel placed at high density in order to obtain finer pixels in response to the need for high quality images. Also, the recording apparatus generally includes ink heads for discharging ink of, for example, cyan, magenta, yellow and black for coloring. Further, the recording apparatus is required to perform a recording operation at higher speed while allowing formation of high quality images, and thus the liquid discharge head has included a larger number of nozzles in order to increase the number of pixels formed at a time to increase the recording speed.

In particular, a method has been embodied such that a liquid discharge head is formed to have a length substantially equal to a width of a maximum print material for recording to allow recording in one pass scan, thereby allowing high speed output. In this case, for a page printer set for A4 paper in a landscape orientation, a length of a liquid discharge head is about 30 cm, and approximately 14000 or more nozzles are required at a nozzle density of 1200 dpi (dot per inch). Manufacturing such a liquid discharge head having a large number of nozzles at a time requires a large machine body, which causes problems in terms of manufacturing costs and yields.

Further, the large number of nozzles prevents all the nozzles from having and maintaining the same performance. This may cause uneven ink discharge amounts or shifted (skewed) dot placement positions between the nozzles, and using a technique of head shading correction has been known for preventing uneven optical densities of recorded images.

General head shading is a method of measuring an optical density of an output pixel for each nozzle to feedback the results to input image data for correcting uneven optical densities. For example, when a certain nozzle discharges a smaller amount of ink for some reasons, and an optical density of that portion is low, correction for increasing a tone level of an input image at a portion corresponding to the nozzle, thereby providing even optical densities of an output image.

The large number of nozzles may include non-discharge nozzles, and a technique of non-discharge nozzle correction (non-discharge supplement) has been known for performing supplementary processing to allow image output even if all the nozzles are not perfect.

Known methods of non-discharge supplement includes a method in which with a non-discharge nozzle, nozzles on both sides of the non-discharge nozzle are used to form dots (pixels) on positions adjacent to a dot (pixel) to be formed by the non-discharge nozzle, or a method of correcting image data for a recording operation so as to include dots around a dot to be formed by a non-discharge nozzle (adjacent supplement). A method of forming an ink dot of a different color such as black on a portion on which a dot is to be formed by a non-discharge nozzle of cyan for supplement (different color supplement) is also known.

SUMMARY OF THE INVENTION

The invention has an object to provide a liquid discharge recording method and a liquid discharge recording apparatus capable of outputting an image at high speed with high quality and high reliability, and has a feature in that when adjacent overlapping dots are formed on a print material, the dots are formed with a dot placement time difference that may reduce uneven optical densities of the overlapping portion of the dots.

DESCRIPTION OF THE PREFERRED EMBODIMENTS

In a liquid discharge recording apparatus, outputting high quality images at high speed at low costs is one direction of technical development. In this respect, manufacturing a long liquid discharge head having nozzles placed at high density, which is effective in forming high quality images at high speed, causes problems such as an increase in costs, a reduction in yields or a difficulty in maintaining performance. As described above, using head shading or non-discharge supplement allows image output by a long liquid discharge head having nozzles placed at high density even if the head has some defects, but quality of the image is inevitably lower than quality of an output image by a perfect liquid discharge head.

In view of the above described circumstances of the conventional techniques, the invention has an object to provide a liquid discharge recording method and a liquid discharge recording apparatus capable of reducing uneven image densities caused by different dot placement time differences when adjacent dots are formed on a print material, and outputting images at high speed with high quality and high reliability.

Now, an embodiment of the invention will be described in detail with reference to the drawings.

[Liquid Discharge Head]

Figure 1A:
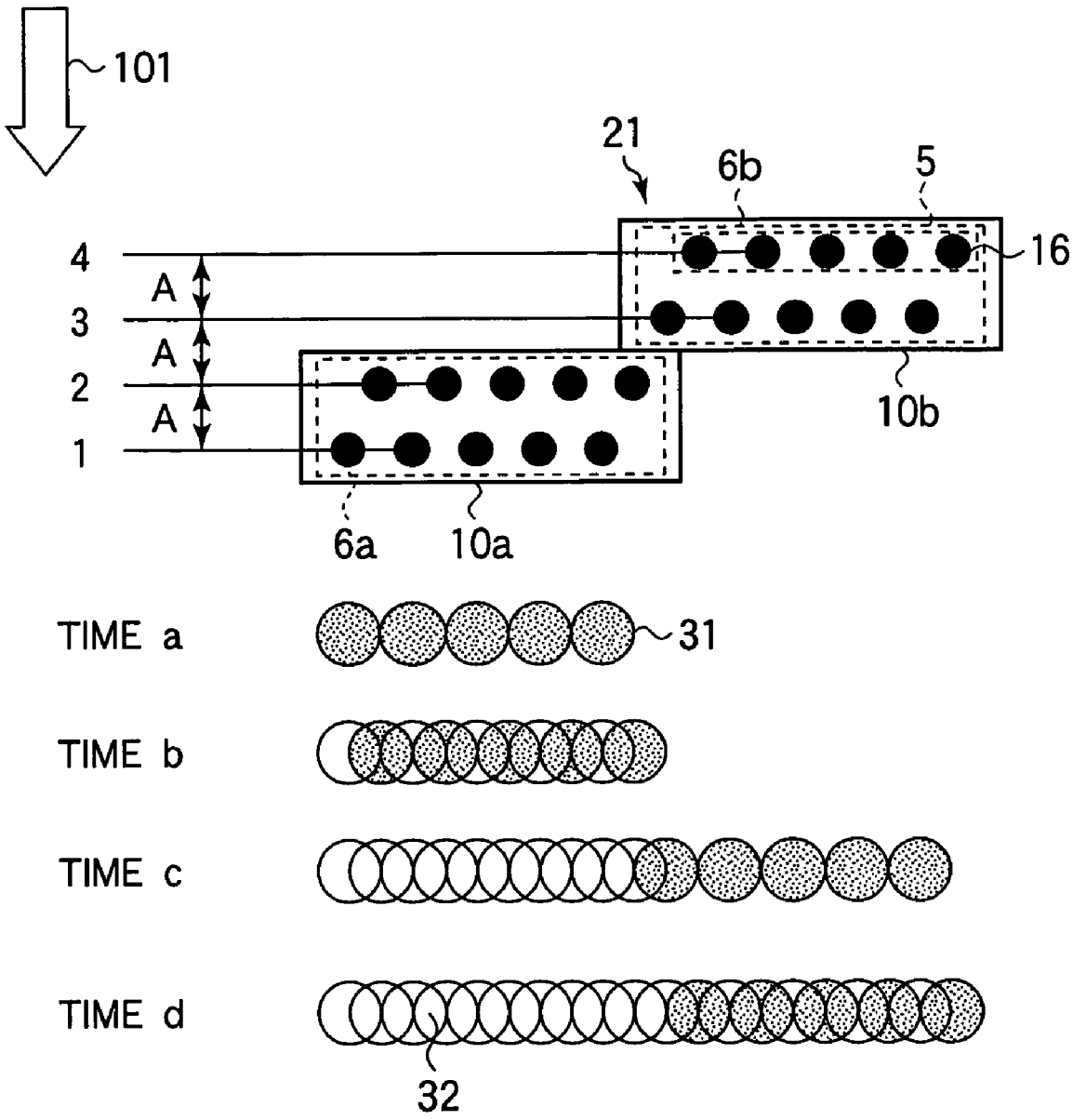
FIGS. 1A and 1B are schematic diagrams of a liquid discharge head of an embodiment of the invention viewed from a side of a discharge port surface, and of dot patterns formed using the head.
Figure 1B:
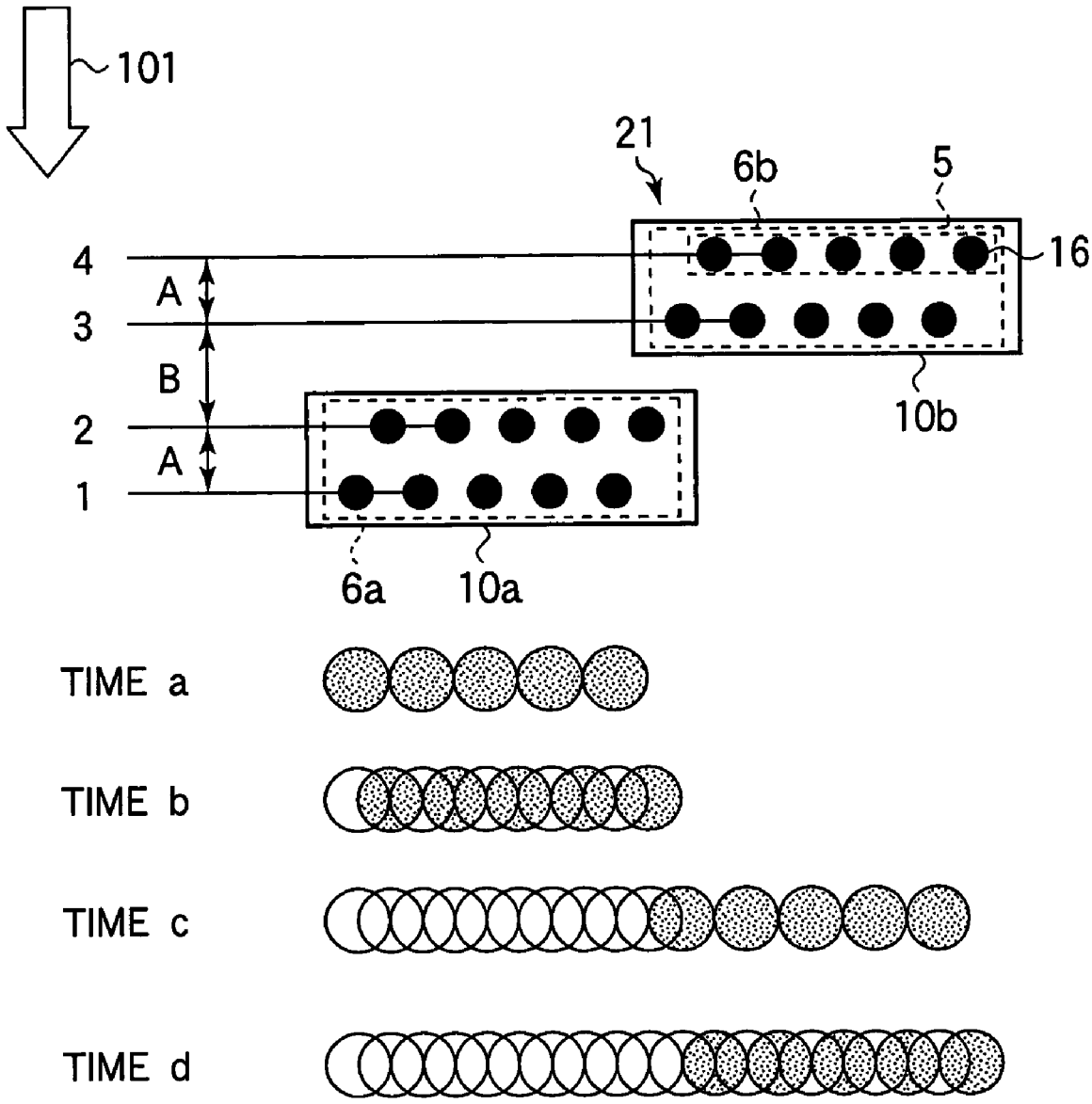

FIGS. 1A and 1B are schematic diagrams of a liquid discharge head (ink jet head) 21 that discharges a liquid such as ink (hereinafter simply referred to as ink) according to the embodiment. As shown in FIGS. 1A and 1B, the liquid discharge head 21 includes a plurality of head chips 10*a*, 10*b*, . . . arranged in a shifted manner in a relative movement direction between the head and a print material, and generally serves as a long liquid discharge head. For the sake of clarity, two head chips only are shown in FIGS. 1A and 1B, but the liquid discharge head 21 according to the embodiment may include a larger number of head chips 10 arranged, for example, in a staggered manner or a step manner. In the description below, such a liquid discharge head including the plurality of head chips is also referred to as a multi-head.

Figure 2:
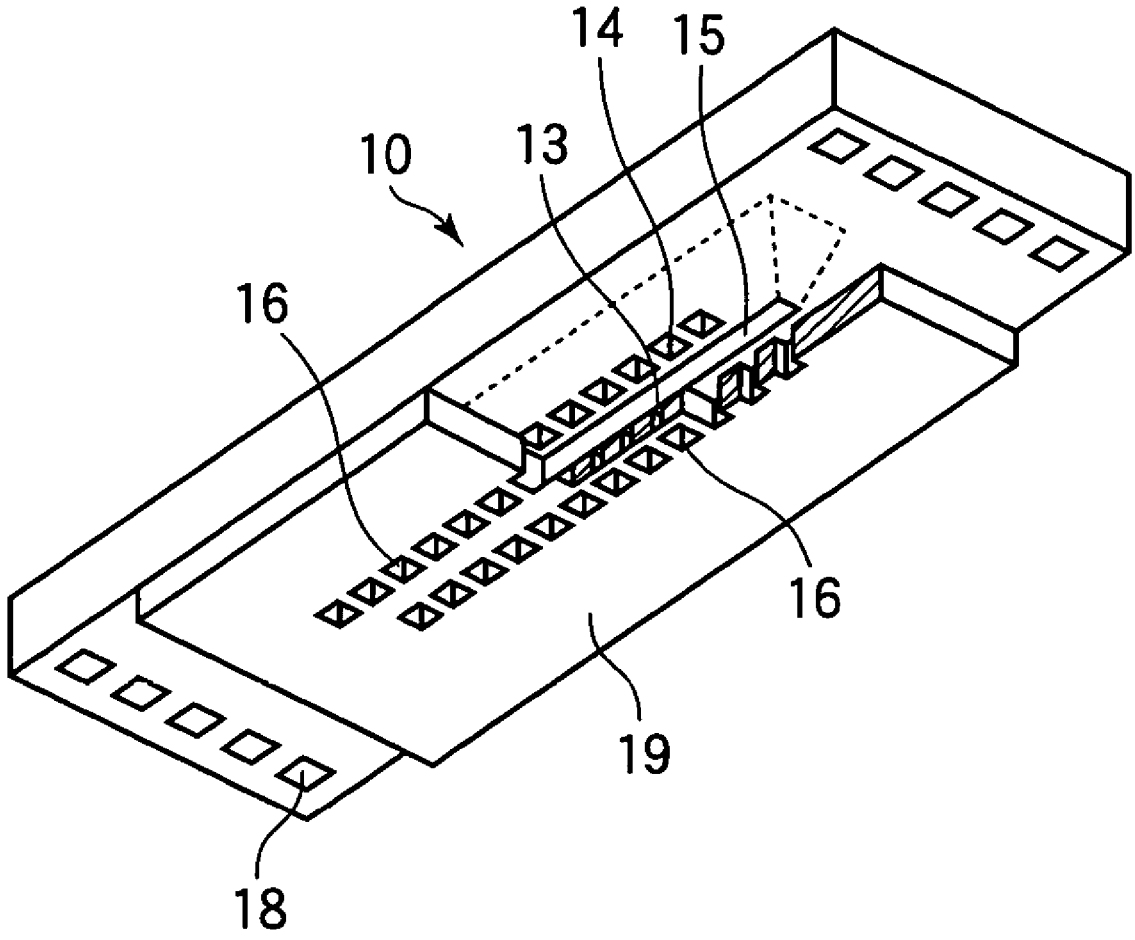
FIG. 2 is a perspective view, partially broken away, of a head chip that forms the liquid discharge head in FIG. 1.
Figure 3:
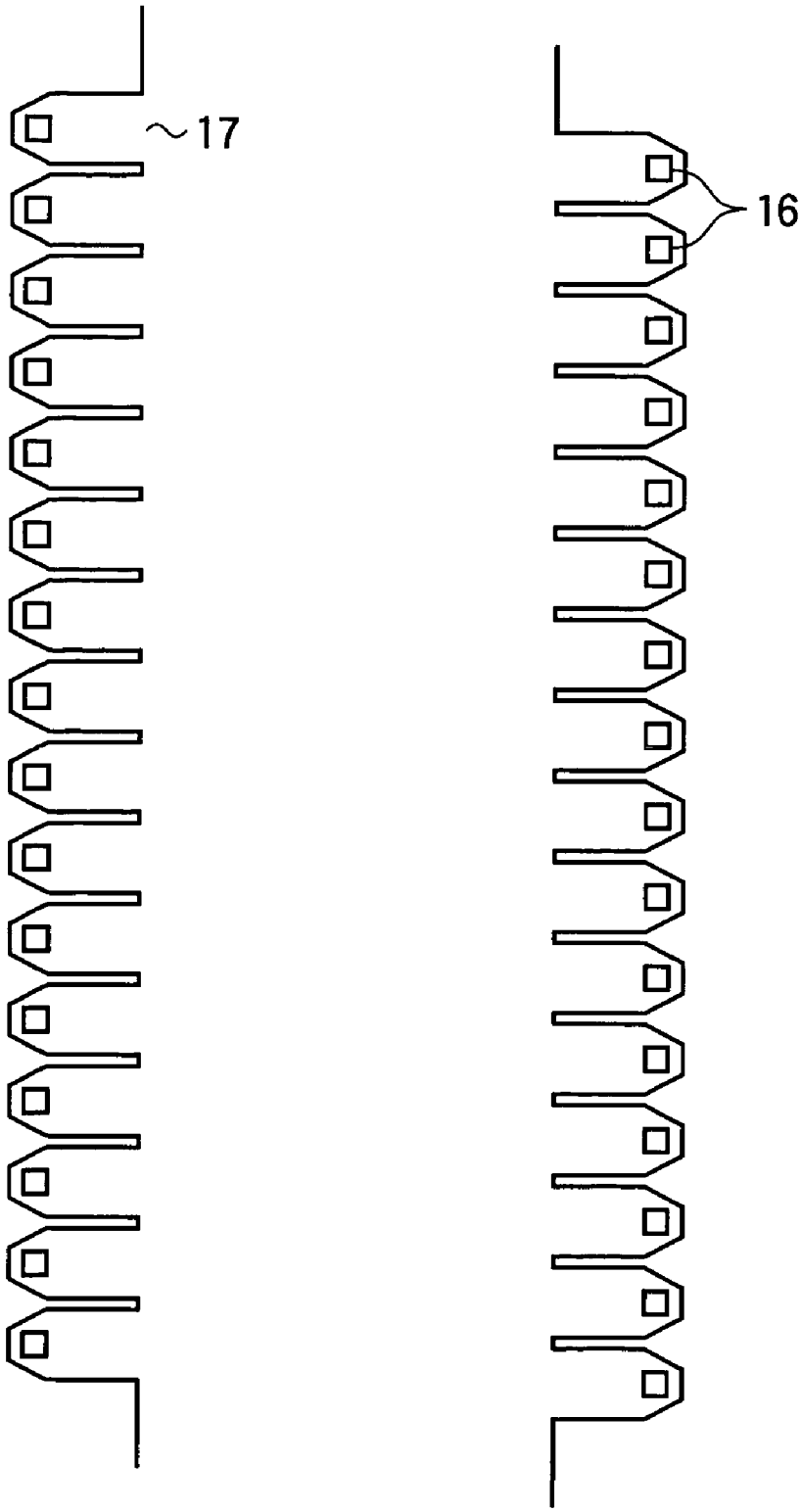
FIG. 3 is a schematic plan view of a nozzle structure of the head chip in FIG. 2.

FIG. 2 shows, partially broken away, a head chip 10 used in a multi-head according to the embodiment of the invention. FIG. 3 is a plan view of a nozzle structure of the head chip 10, and shows a positional relationship between ink channels 17 formed by ink chambers 13 in FIG. 2 and discharge ports 16. The head chip 10 is manufactured using, for example, a Si wafer, and has an elongated ink supply port 15 formed therein, and a top plate 19 that forms the discharge ports 16 and the ink chambers 13 is provided on the Si wafer.

Two arrays of ink chambers 13 arranged at a predetermined pitch along a length of the ink supply port 15 are formed so that the ink supply port 15 is placed therebetween. Each ink chamber 13 includes an energy generating element 14 and a discharge port 16 that faces the energy generating element 14 and discharges ink as a droplet.

In the embodiment, two parallel arrays of discharge ports 16 with the ink supply port 15 placed therebetween are staggered with a half pitch shifted, and a pitch between the discharge ports 16 arranged along the length of the ink supply port 15 is half the pitch between the ink chambers 13 corresponding to the discharge ports 16 in each array in appearance. The pitch between the discharge ports herein refers to a pitch between the centers of gravity of the discharge ports. For circular discharge ports, the pitch refers to a pitch between the centers of the discharge ports. The energy generating element 14 and an unshown electrode wiring that is made of Al or the like and supplies electric power to the energy generating element 14 are formed on a surface of the Si wafer by a deposition technique, and the other terminal of the electrode wiring forms a bump 18 that is made of Au or the like and protrudes from a surface of a heating substrate 12.

The energy generating element 14 in the embodiment is part of a heating resistor layer 19 that is not covered with the electrode wiring made of Al or the like but is made of, for example, TaN, TaSiN or Ta—Al, and has a predetermined sheet resistance value. The energy generating element 14 and the energy generating element are covered with an unshown protective layer made of SiN of a predetermined thickness, and an unshown cavitation resistant layer made of Ta of a predetermined thickness is deposited on a surface of the protective layer on the electrothermal converting element 14.

The ink supply port 15 is formed by anisotropic etching using a crystal orientation of the Si wafer used as the heating substrate. Specifically, with crystal orientations of <100> in a surface of the Si wafer and <111> in a direction of thickness, an alkaline anisotropic etching solution such as KOH, tetramethylammonium hydroxide (TMAH) or hydrazine is used to provide selectivity in an etching direction for etching in a desired depth. The ink chamber 13 and the discharge port 16 are formed by a photolithography technique, and electric power is supplied to the energy generating element 14 to discharge an ink droplet of, for example, 4 picoliter from the discharge port 16.

In FIGS. 1A, 1B, 2 and 3, a small number of energy generating elements 14 and discharge ports 16 are shown for the sake of clarity, but each head chip 10 may have a larger number of discharge ports 16.

[Liquid Discharge Recording Apparatus]

Figure 4:
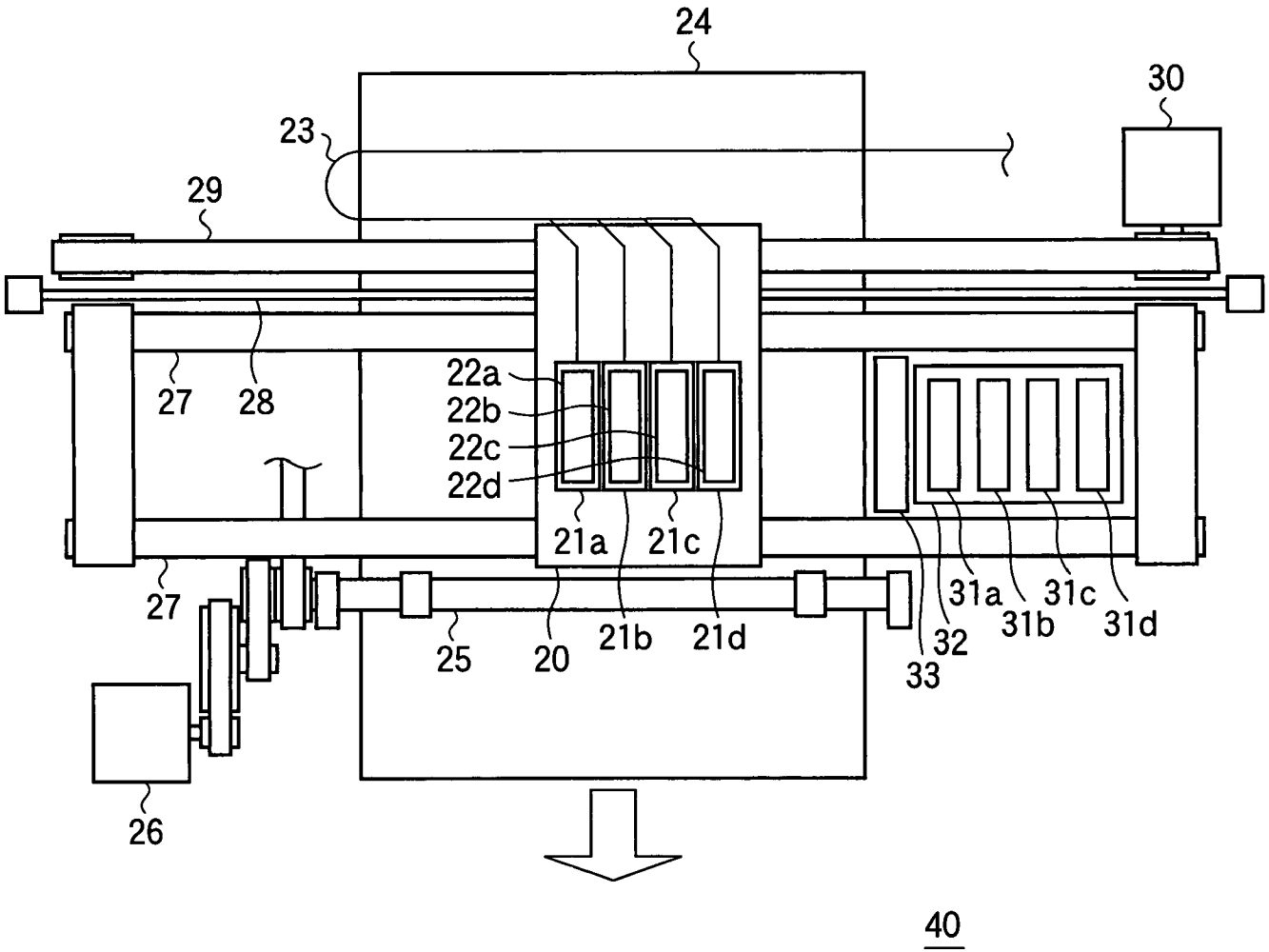
FIG. 4 is a schematic diagram of a liquid discharge recording apparatus including the liquid discharge head in FIG. 1.

FIG. 4 schematically shows a liquid discharge recording apparatus (an ink jet recording apparatus) according to the embodiment to which the liquid discharge head of the invention may be applied. The apparatus forms an image by placing liquid droplets from discharge ports onto a print material to form dots while moving the liquid discharge head as described above relative to the print material.

The liquid discharge recording apparatus 40 includes liquid discharge heads 21*a*, 21*b*, 21*c* and 21*d* for discharging ink of black (K), cyan (C), magenta (M) and yellow (Y) as the liquid discharge head 21 having the above described configuration. The liquid discharge heads 21 are incorporated in a carriage 20 together with ink cartridges 22*a*, 22*b*, 22*c* and 22*d* holding ink corresponding to the colors. Each ink cartridge 22 is connected to an ink supply port of each liquid discharge head 21 via a tube.

The carriage 20 is reciprocally supported by a guide shaft 27 along the guide shaft 27 (in a main scanning direction). A drive belt 29 spanning pulleys is connected to the carriage 20, a carriage motor 30 is connected to one of the pulleys, and the carriage 20 is reciprocated by driving the carriage motor 30. In the movement, a liquid such as ink is discharged from the discharge port onto the print material as a liquid droplet to form a dot on the print material. In a moving path of the carriage 20, a linear encoder 28 used for drive control of the liquid discharge head 21 is placed along the guide shaft 27. In order to provide control signals to each liquid discharge head 21 on the carriage 20 thus reciprocated, a flexible cable 23 is connected to the carriage 20.

The liquid discharge recording apparatus 40 forms an image on a sheet-like print material 24, and includes a conveyance mechanism that conveys the print material 24 in the direction of arrow in FIG. 4 (a sub scanning direction) through a position facing a discharge port forming surface into which the discharge ports 16 open of the liquid discharge head 21 incorporated in the carriage 20 and moved. The print material 24 includes plain paper, high quality paper, OHP sheet, glossy paper, glossy films, post cards, or the like.

The conveyance mechanism includes an unshown conveyance roller in addition to a shown paper delivery roller 25, and these rollers are rotatably driven by a conveyance motor 26. Thus, the print material 24 is first held by the conveyance roller and conveyed, and when a tip of the print material 24 reaches the paper delivery roller 25, the print material 24 is conveyed by both the conveyance roller and the paper delivery roller 25 and finally discharged to an unshown paper delivery portion.

The liquid discharge recording apparatus 40 includes a recovery unit 32 for appropriately recovering discharge performance of the liquid discharge head 21 that may be reduced by an increase in viscosity of ink in the liquid discharge head 21 with time, and reducing occurrence of poor discharge or clogging. The recovery unit 32 has caps 31*a*, 31*b*, 31*c* and 31*d* placed so as to face the discharge port forming surfaces of the ink discharge heads 21 when the carriage 20 is placed in a home position set outside a recording area.

When no recording operation is performed, the carriage 20 is moved to this home position, and the discharge port forming surface of each ink discharge head 21 is sealed by each cap 31. This prevents the increase in viscosity of the ink caused by evaporation of an ink solution or deposition of foreign matter such as dust on the discharge port forming surface, thereby reducing occurrence of clogging or the like. A pump may be connected to the cap 31 and actuated with the cap being fitted to suck the ink from the discharge port 16 as appropriate. This allows the ink with increased viscosity to be sucked to recover the discharge performance to a satisfactory state. The cap 31 may be used for idle discharge for discharging ink from a discharge port 16 from which ink is less frequently discharged in the recording operation among the discharge ports 16 to the cap 31 apart from the discharge port forming surface, thereby allowing recovery of the discharge performance. A configuration may be further included in which a wiping member such as a blade is placed adjacent to the cap 31, and the discharge port forming surface of each liquid discharge head 21 is cleaned by the member.

An ink receiving portion 33 is provided in the home position. The ink receiving portion 33 is used for preliminary discharge against the ink receiving portion 33 when each liquid discharge head 21 passes above the ink receiving portion 33 immediately before the recording operation.

The recording operation by the liquid discharge recording apparatus 40 according to the embodiment is performed by conveying the print material 24, that is, reciprocating the carriage 20 while performing sub scanning, and at this time, selectively discharging ink from each liquid discharge head 21 in accordance with input image data. Each liquid discharge head 21 is driven by determining an operational position of the carriage 20 by a signal from the linear encoder 28, and selectively providing a drive pulse voltage to each heater 12 at a predetermined timing in accordance with the determination. This causes an ink droplet discharged from each liquid discharge head 21 to fly and be deposited on a predetermined position on the print material 24 to form a dot on the print material 24, and formed dots form an image corresponding to the input image data.

FIG. 4 shows a serial type liquid discharge recording apparatus 40 that performs the main scanning for moving the liquid discharge head 21 and the sub scanning for moving the print material 24, but the liquid discharge head 21 according to the embodiment may be of a full-line type having a length corresponding to a width of a maximum print material 24 used for recording, and the liquid discharge recording apparatus may be adapted to move any one of the liquid discharge head 21 and the print material 24 for recording on the entire print material 24.

Figure 5:
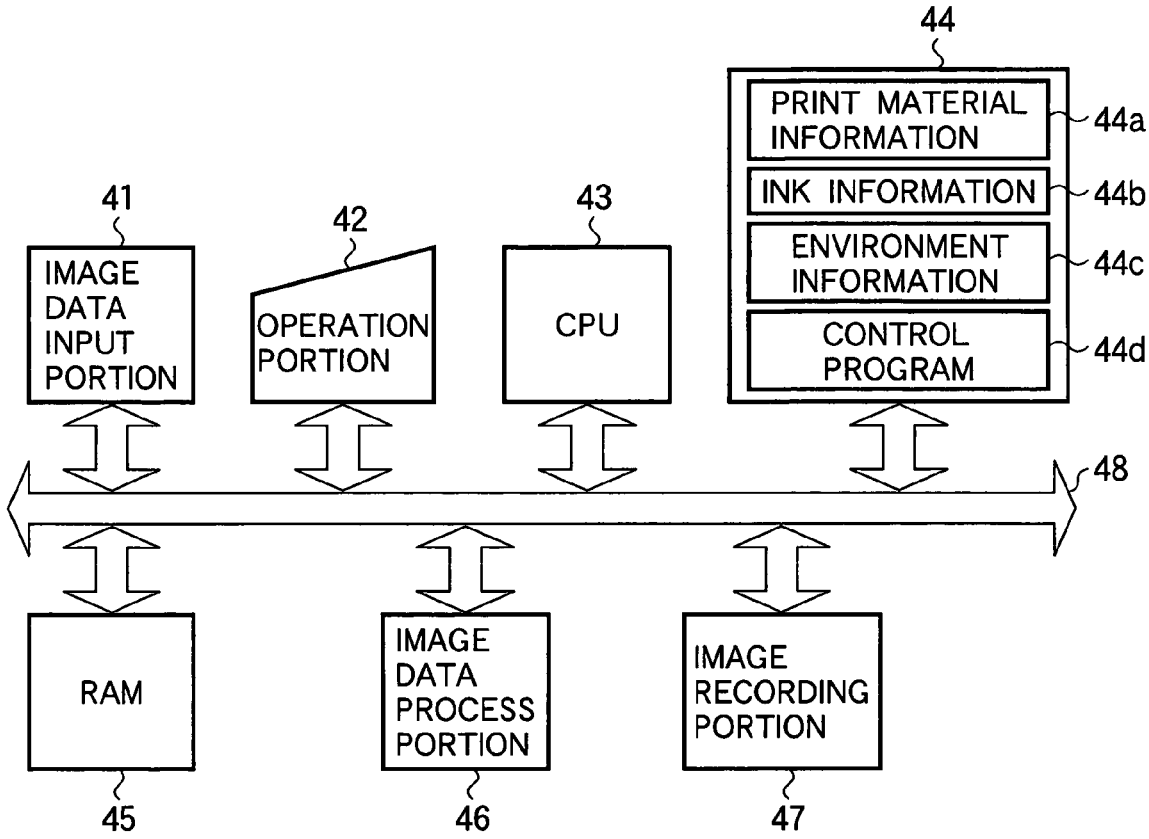
FIG. 5 is a schematic block diagram of a control system of the liquid discharge recording apparatus in FIG. 4.

The liquid discharge recording apparatus 40 has a control system that performs recording operation control as described above. FIG. 5 is a block diagram of an example of a configuration of the control system.

In the control system, an image data input portion 41, an operation portion 42, a CPU 43, a RAM 45 and an image data process portion 46 are connected via a bus line 48 that transmits address signals, various types of data, control signals or the like in the apparatus. Operation mechanisms or detection mechanisms such as the liquid discharge head 21, the carriage motor 30, the conveyance motor 26 and the linear encoder 28 are connected to the bus line 48, and these mechanisms are collectively indicated as an image recording portion 47.

The CPU 43 performs predetermined various types of information processing based on a control program 44*d* for generally controlling the entire liquid discharge recording apparatus 40. The control program 44*d* includes programs for operation control of the above described portions and an error processing program, and is stored in a storage medium 44 such as a ROM, an FD, a CD-ROM, an HD, a memory card or a magneto-optical disk and supplied. The CPU 43 reads the control program 44*d* from the storage medium 44 via the bus line 48 for operation, and in some cases, the control program 44*d* is read by a reader and once stored in the work RAM 45 or the like that is a different temporary storage, and then supplied to the CPU 43 therefrom. In the storage medium 44, print material information 44*a* mainly on a type of a print material, ink information 44*b* on ink used for recording, and environment information 44*c* on an environment such as temperature or humidity in the recording operation may be stored and used for satisfactory recording control.

The work RAM 45 is mainly used as a work area for various types of programs, a temporary waiting area in error processing, and a work area in image processing. The work RAM 45 may be used for copying various types of tables in the storage medium 44 and changing the contents of the tables to be used for image processing.

The image data input portion 41 serves to input image data from an image input apparatus such as a scanner or a digital camera, or image data stored in a hard disk of a personal computer to the liquid discharge recording apparatus 40. The operation portion 42 includes various types of keys for an operator to set various types of parameters or perform input processing such as an instruction to start the recording operation.

The image data process portion 46 serves to finally convert the image data input from the image data input portion 41 to data that can be used as a discharge pattern including binary information indicating whether an ink dot of each color is formed on each dot position. Such conversion can be performed using a technique generally conventionally used.

For example, multilevel image data is input from the image data input portion 41. The image data process portion 46 separates colors of the multilevel image data correspondingly to the color of the ink discharged from each liquid discharge head 21, quantizes each color to image data of an N value for each pixel, and prepare a discharge pattern corresponding to a tone level "K" in each quantized pixel. For example, when multilevel image data in 8 bit (256 tones) is input to the image data input portion 41, a tone level of image data to be output is converted to 25 (=24+1) level in the image data process portion 46. For such K-level processing of input tone image data, a multilevel error diffusion method may be used, but not limited to this, any half tone processing method such as an average optical density conservation method or a dither matrix method may be used. Then, the K-level processing is repeated as many as the number of all pixels based on optical density information of the image to generate data including binary information indicating whether a dot of each color is formed on each dot position.

Next, the recording operation by the liquid discharge recording apparatus 40 according to the embodiment will be described in detail. First, a recording operation by a liquid discharge recording apparatus of a comparative example for comparison with the embodiment will be described.

FIRST COMPARATIVE EXAMPLE

Figure 6:
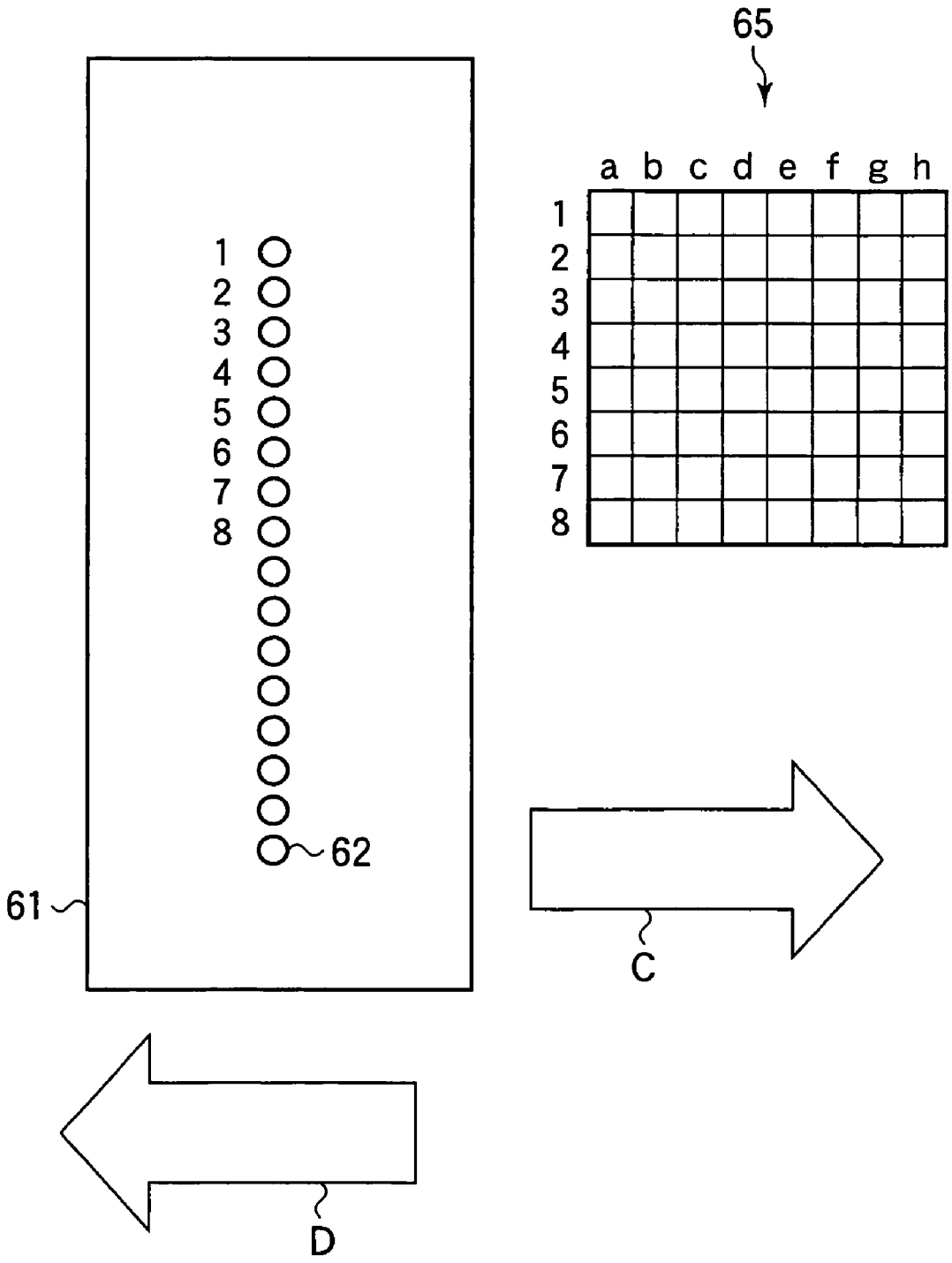
FIG. 6 is a schematic diagram of a liquid discharge head of a first comparative example viewed from a side of a discharge port surface, and shows a recording matrix for illustrating dot positions formed using the head.

FIG. 6 illustrates a recording operation by a long liquid discharge head 61 having all discharge ports 62 arranged in a line as a first comparative example of the embodiment. In FIG. 6, the arrow C shows a movement direction of the liquid discharge head 61 relative to a print material in the recording operation. Alternatively, the print material may be moved relative to the liquid discharge head 61 as shown by the arrow D. Ink is selectively discharged from each discharge port 62 at a predetermined frequency while the liquid discharge head 61 and the print material are moved relative to each other, to selectively deposit ink on each dot position in a recording matrix 65 schematically shown and form a dot pattern.

Specifically, ink is discharged from a discharge port 62 with the number 1 to form a dot on a dot position with the recording line number 1 in the recording matrix 65, and ink is discharged from a discharge port 62 with the number 2 to form a dot on a dot position with the recording line number 2 in the recording matrix 65. At this time, when a liquid discharge head 61 having 1280 discharge ports 62 arranged at 1200 dpi (about a 21.2 μm pitch) is used, a pitch between the dots in the recording matrix 65 is about 21.2 μm. When a size of a dot formed by an ink droplet is larger than the pitch, adjacent dots overlap. When the dot formed by the ink droplet is much larger, diagonally adjacent dots also overlap as in dot positions (1, a) and (2, b). When the ink droplet is not placed on an ideal position (the center of each dot position in the recording matrix 65), adjacent dots may also overlap.

Figure 7A:
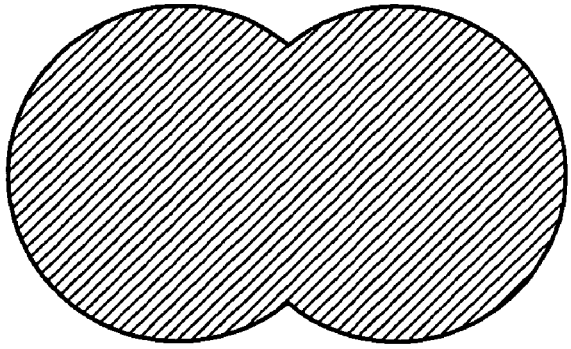
FIGS. 7A, 7B and 7C show dot shapes when dots are formed in adjacent dot positions.
Figure 7B:
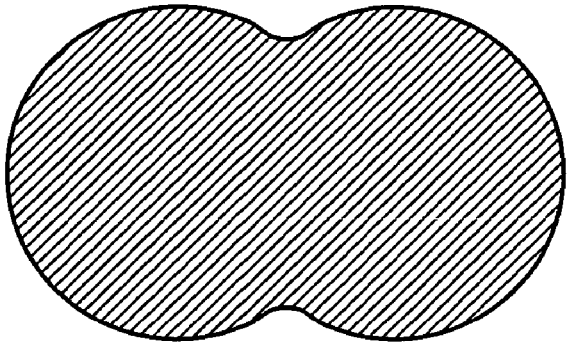
Figure 7C:
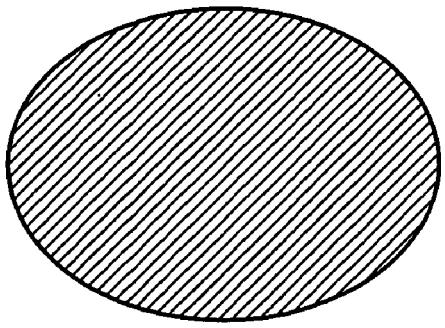

When the dots thus overlap, and interlace recording or multipass recording is performed by a conventional serial type recording apparatus, shapes of adjacent overlapping dots is the same as shapes when dots are independently formed as shown in FIG. 7A. On the other hand, when the liquid discharge head 61 in the comparative example is used to perform recording in one pass, adjacent dots cooperate to form an oval dot as shown in FIG. 7C. For diagonally adjacent dots, a gourd-shaped dot is formed with the shapes of the dots being changed in the overlapping portion as shown in FIG. 7B, or an ideal dot shape cannot be obtained.

In the interlace recording or the multipass recording, there is a certain difference in dot placement time between ink droplets onto the adjacent dot positions, while in the comparative example, dot placement time is substantially the same between the dot positions (1, a) and (2, a), or the like. This may be caused by the fact that assuming that a drive cycle of a heater, for example, a drive frequency is 10 kHz, the dot placement time difference is only 0.1 msec between the dot positions (1, a) and (1, b) or the dot positions (1, a) and (2, b) or the like. Specifically, after an ink droplet is placed on a print material and before the ink droplet is absorbed into the print material, another ink droplet is placed on an adjacent dot position to cause the ink droplets to be integrated on the print material, thereby damaging a desired dot shape. In other words, an absorption speed of the ink droplet into the print material cannot follow a recording speed. Thus, such a tendency may become more pronounced with increase in the drive frequency of the heater and the recording speed.

Thus, the inventors have found, in view of the absorption time of the ink into the print material, that when dots are formed in adjacent dot positions, forming the dots with a time difference longer than the absorption time of the ink into the print material is effective in obtaining high quality images in high speed recording.

Now, measurement of an absorption behavior of the ink into the print material for calculating the absorption time will be described in detail.

A general measurement method for those skilled in the art is a Bristow method prescribed by J-TAPPI. By this method, a penetration speed of ink into a print material within a minimum time after the ink comes into contact with a surface of the print material can be calculated as an absorption speed coefficient, and specifically, a time for ink per unit volume to be absorbed into the print material in a unit area of the print material can be calculated. By this method, a time for ink (BCI5C: manufactured by Canon Inc.) used in BJF850 (manufactured by Canon Inc.) to be absorbed into Pro Photo Paper (PR101: manufactured by Canon Inc.), ink jet and electrophotography plain paper (PBPAPER: manufactured by Canon Inc.) and ink jet high quality paper (HR101: manufactured by Canon Inc.) is measured to obtain the results shown in Table 1.

TABLE 1

| | 10 ml/m$^2$ | 20 ml/m$^2$ |
|---|---|---|
| PR101 | 8 msec | 28 msec |
| PB paper | 1 msec | 4 msec |
| HR101 | 1 msec | 5 msec |

At this time, the Pro Photo Paper PR101 has a hollow ink absorption layer, and a time for the ink droplet to be absorbed into the ink absorption layer is relatively long. Then, when dots are formed on the Pro Photo Paper by the above described ink, the dot placement time difference between ink droplets onto adjacent positions is set to 8 msec or higher for an amount of ink droplet to be deposited of 10 ml/m$^2$ and 28 msec or higher for an amount of 20 ml/m$^2$, thereby reducing deformation of formed dots as described above.

SECOND COMPARATIVE EXAMPLE

Figure 8:
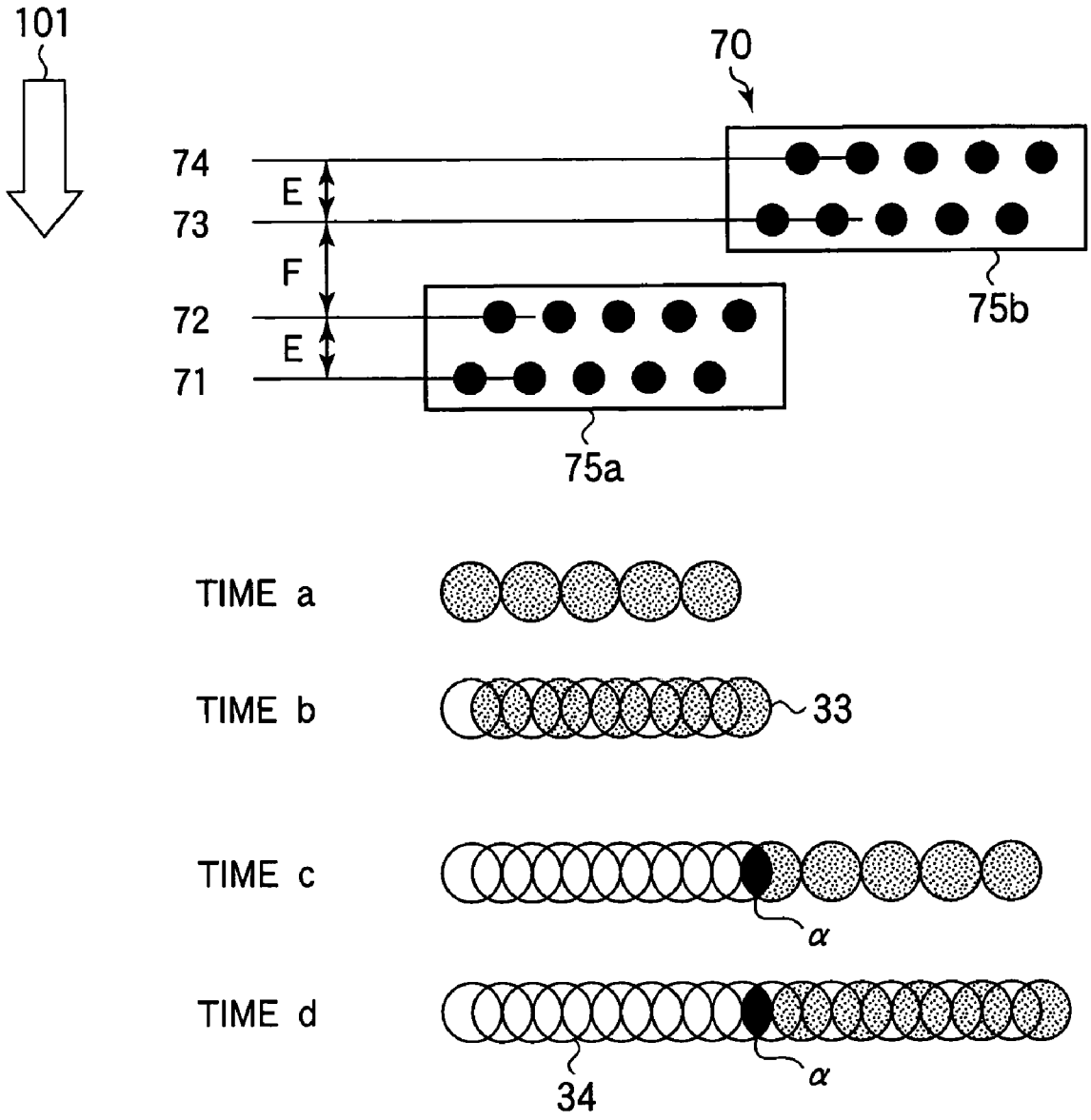
FIG. 8 is a schematic diagram of a liquid discharge head of a second comparative example viewed from a side of a discharge port surface, and of dot patterns formed using the head.

Next a liquid discharge head 70 of a second comparative example is shown in FIG. 8.

The liquid discharge head 70 is a multi-head having a plurality of head chips 75*a*, 75*b*, . . . arranged like the embodiment. For the sake of clarity, two head chips 75 only are shown in FIG. 8, but the liquid discharge head 70 may have a larger number of head chips arranged.

In FIG. 8, a direction perpendicular to discharge port arrays is a main scanning direction of the liquid discharge head 70 or a relative movement direction between the liquid discharge head 70 and a print material when a full-line type liquid discharge head 70 is used (hereinafter referred to as a main scanning direction 101). The head chips 75 are arranged perpendicularly to the main scanning direction in a shifted manner in the main scanning direction. In the entire liquid discharge head 70, the head chips 75 are placed on discharge port lines 71, 72, 73 and 74 extending at a regular distance in parallel with the direction perpendicular to the main scanning direction.

In the lower part of FIG. 8, time-series formed dot patterns are shown when dots arranged perpendicularly to the main scanning direction of the print material are formed by the liquid discharge head 70. Specifically, when the dots arranged perpendicularly to the main scanning direction are formed by the liquid discharge head 70, dots are first formed by liquid droplets (ink droplets) discharged from discharge ports 76 on the discharge port line 71 in a time a. At this time, a pitch between the discharge ports 76 in each discharge port array is twice a pitch between the formed dots, and the dots formed on the print material are thus substantially independent and hardly overlap. Likewise, dots are formed by ink droplets discharged from discharge ports 76 placed on the discharge port line 72 in a time b, the discharge port line 73 in a time c, and the discharge port line 74 in a time d. In FIG. 8, for the sake of clarity, dots 33 formed in each time are diagonally shaded, and dots formed before each time is shown by open circles.

At this time, intervals t between times a-b, b-c and c-d are expressed by the expression:

$$t=L/Ft \quad (1)$$

where L is a distance between the discharge port lines (a distance between the discharge port arrays) and F is a recording speed, that is, a relative speed between the liquid discharge head 70 and the print material in main scanning.

For example, when a drive frequency of a heater in each nozzle is 10 kHz, and a recording density (recording matrix resolution) in the main scanning direction is equal to a density of the discharge ports 76 at 1200 dpi (thus, an area of each dot in the recording matrix is about 20 $\mu m^2$ the recording speed F is 0.2 mm/msec. Then, when an ink droplet of 10 $ml/m^2$ is placed on Pro Photo Paper (PR101) as a print material to form a dot, the absorption time T of the ink droplet is 8 msec in Table 1, and the intervals t between the times a, b, c and d can be the absorption time. A distance Lpr between the discharge port lines is 1.6 mm (corresponding to about 80 dots) from the expression (1). When an ink droplet of 20 $ml/m^2$ is placed on the Pro Photo Paper (PR101) as the print material to form a dot, the absorption time T of the ink droplet is 28 msec, and the intervals t between the times a, b, c and d can be the absorption time. A distance between the discharge port lines is 5.6 mm (corresponding to about 265 dots).

In the liquid discharge head 70 in the comparative example, the distances between the discharge port lines 71, 72, 73 and 74 are set close to the distance Lpr that allows a dot to be formed after an ink droplet is absorbed into the print material in an adjacent dot in the recording operation. Specifically, a distance E between two discharge port arrays in each head chip is set close to the distance Lpr. Further, a distance F between adjacent discharge port arrays in the head chips 75 shifted in the main scanning direction (for example, 75*a* and 75*b*) is also set close to the distance Lpr. This prevents dots adjacent to each other and overlapping perpendicularly to the main scanning direction from forming an oval dot or a gourd-shaped dot.

It is repeatedly described that the Lpr value represents the distances between the discharge port lines 71, 72, 73 and 74 required for ink from an adjacent discharge port 76 to be placed on the print material after a certain amount of ink is extended in a unit area and a time for the ink to be absorbed into the print material has passed. Thus, in the recording operation, the Lpr value differs depending on the amount of ink discharged from the discharge port 76. Generally, a total amount of discharged ink for all colors is preferably used for calculating the Lpr value, but in such a case that there is an enough distance between the colors, an amount of discharged ink for each color may be used for calculating the Lpr value.

The absorption time K used for calculating the Lpr value is calculated by the Bristow method in the above example, but may be calculated by using other measurement techniques for determining an absorption speed or by visually determining whether the ink is absorbed. Also, dots may be formed on adjacent dot positions with a dot placement time difference being changed, and shapes of the dots thus formed may be observed to estimate the absorption time. Specifically, when an ink droplet is placed on an adjacent dot position before an ink droplet is absorbed into a print material, and the ink droplets are integrated, the dots sometimes form a gourd shape (as shown in FIG. 7B) or an oval shape (as shown in FIG. 7C). This allows the time for the ink droplet to be absorbed into the print material to be estimated.

The configuration in the comparative example in FIG. 8 prevents the ink droplets placed on the dot positions adjacent to each other perpendicularly to the main scanning direction from being integrated before absorbed into the print material to prevent deformation of the dots, thereby improving image quality.

However, it has been found, from an observation of quality of the image formed by the comparative example in FIG. 8 in detail, that uneven optical densities partially occur perpendicularly to the main scanning direction to produce high optical density portions in streaks. The inventors have studied this, and found that an optical density of an overlapping portion of dots changes with dot placement time differences between ink droplets of the overlapping dots. This will be now described.

Figure 9:
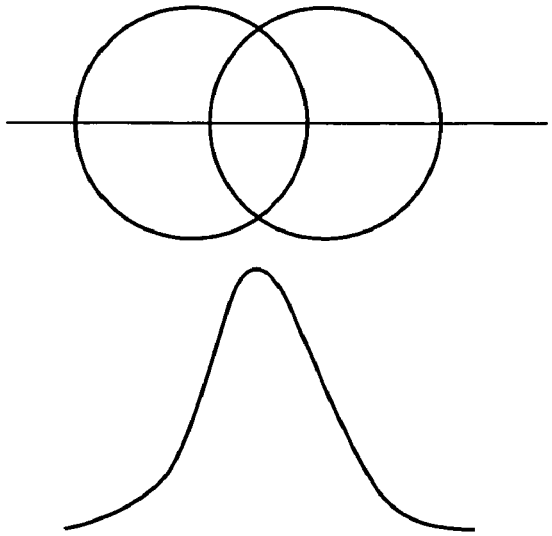
FIG. 9 shows an optical density distribution of an overlapping portion of dots.

FIG. 9 shows an optical density distribution when dots having an adjacent overlapping portion are formed. As is apparent from FIG. 9, the optical density is maximum in the overlapping portion, and gradually becomes lower toward peripheries.

Figure 10:
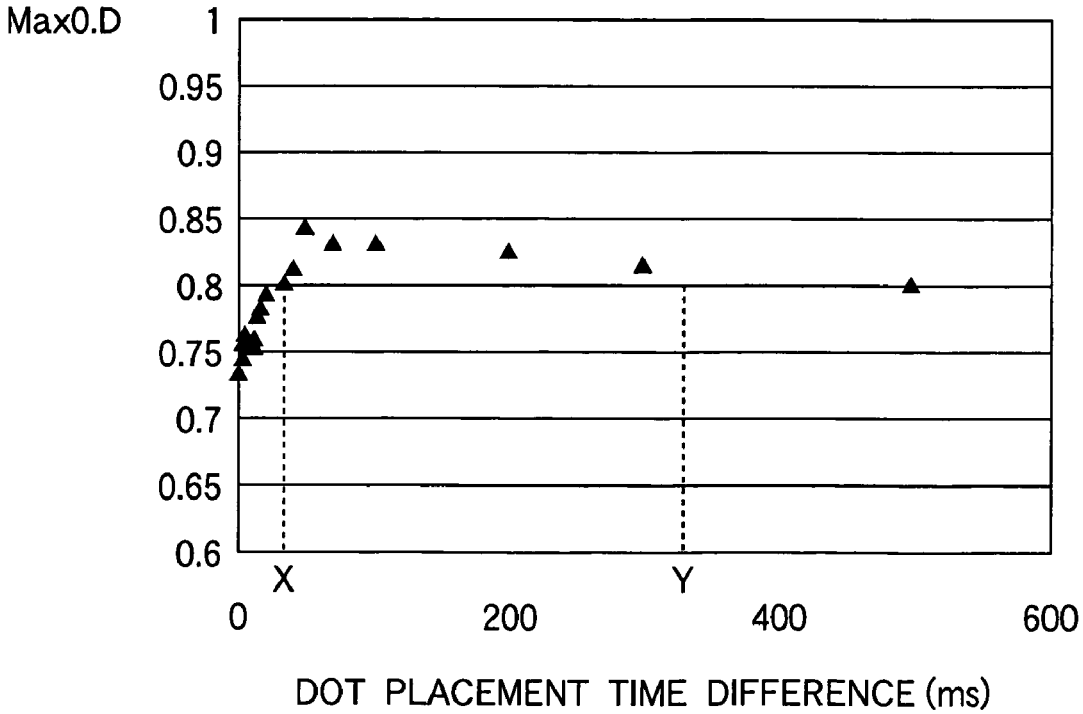
FIG. 10 is a graph showing changes of a maximum optical density in FIG. 9 with dot placement time differences of ink droplets onto adjacent dot positions.

Next, FIG. 10 shows the measurement result of changes with the dot placement time differences of the maximum optical density (Max O.D). As is apparent from FIG. 10, the maximum optical density abruptly changes with the changes in dot placement time difference until the dot placement time difference of about 50 msec, and with a longer dot placement time difference, the maximum optical density is settled at a fixed value. This result is obtained by using BJF850 (manufactured by Canon Inc.) with BCI5C (manufactured by Canon Inc.) as ink is used to record on Pro Photo Paper (PR101: manufactured by Canon Inc.) with the dot placement time difference being changed, and measuring the optical density after a sufficient time has passed.

The optical density is calculated by measuring input data of a 10 $\mu m^2$ area by a CCD camera mounted to a microscope with a 50× optical lens.

In the dot patterns formed by the liquid discharge head 70 in FIG. 8, for most of the adjacent dots, for example, a dot adjacent to the dot formed in the time a is formed in the time b, and a dot adjacent to the dot form in the time b is formed in the time c, that is, the dot placement time differences between the times a-b and between the times c-d are the same. However, in FIG. 8, the difference between the times b-c is longer than the differences between the times a-b and the times c-d, and the dot placement time difference is different for the dot indicated by α. Specifically, the dot indicated by a is placed with αlonger dot placement time difference than the dot placement time difference between other adjacent dots. Thus, in recording at a high optical density, the portion of the dot αhas a different optical density from other portions and looks like streaks.

Figure 12:
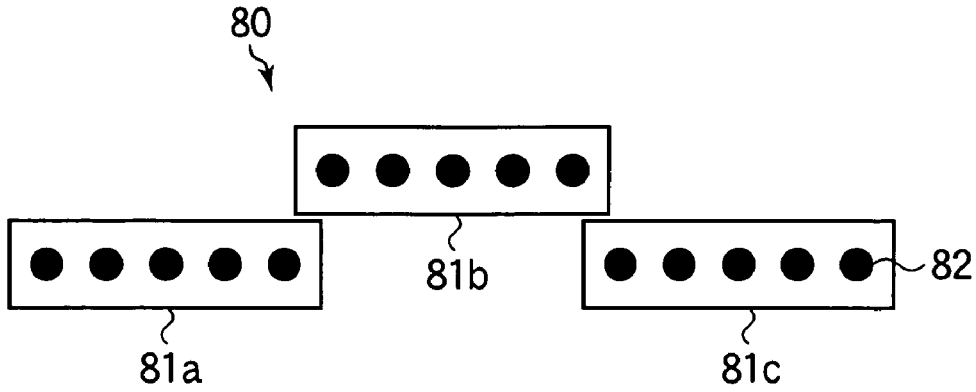
FIG. 12 is a schematic diagram of a liquid discharge head of a comparative example viewed from a side of a discharge port surface.

The uneven optical densities caused by the dot placement time difference between the adjacent dots also occur when using a liquid discharge head 80 as shown in FIG. 12. In the liquid discharge head 80 shown in FIG. 12, each head chip 81 includes one array only of discharge ports 82 perpendicularly to a relative movement direction between the head and a print material. In this case, a dot placement time difference when ink droplets discharged from each head chip 81 are placed on adjacent dot positions is different from a dot placement time difference when ink droplets discharged from a head chip 81*a* or 81*c* and a head chip 81*b* in shifted positions in a main scanning direction are placed on adjacent dot positions, and thus uneven optical densities sometimes occur perpendicularly to the main scanning direction in a formed image.

In the configuration of the above described comparative example, it has been found that there are partial differences in the dot placement time differences of the dots adjacent to each other and overlapping perpendicularly to the main scanning direction on the print material, and the difference in the optical density by the dot placement time differences (see FIG. 10) causes streaks in the formed image.

Thus, in below described embodiments, a method for obtaining a high quality image by reducing a difference in optical density value between dots adjacent to each other and overlapping perpendicularly to a main scanning direction will be described. Specifically, a method will be described for adjusting a dot placement time difference when ink droplets discharged from each head chip are placed on adjacent dot positions, and a dot placement time difference when ink droplets discharged from head chips in shifted positions in the main scanning direction are placed on adjacent dot positions to a dot placement time difference that provides substantially the same optical density.

Embodiment 1

A liquid discharge head 21 according to the embodiment will be described.

As shown in FIG. 1A, in the liquid discharge head 21 according to the embodiment, head chips 10*a*, 10*b*, . . . are arranged perpendicularly to a main scanning direction 101 in a shifted manner in the main scanning direction 101 of the head that is a relative movement direction between the head and a print material. In the general liquid discharge head 21, discharge port lines 1, 2, 3 and 4 on which discharge ports 16 are placed extend in parallel like Comparative example 2. In the embodiment, a distance between two discharge port arrays in one head chip and a distance between adjacent discharge port arrays in the adjacent head chips 10*a* and 10*b* are both a distance A.

The distance A is preferably set, as described above, close to a distance Lpr corresponding to a time difference between when a formerly placed ink droplet is absorbed into the print material and when a later ink droplet is placed in dot positions adjacent to each other and overlapping perpendicularly to the main scanning direction 101 in the recording operation. This allows the ink droplets to be integrated on the print material between the dots adjacent to each other perpendicularly to the main scanning direction to reduce deformation of the dots and improve quality of a formed image. This configuration is particularly effective in using a print material having a hollow ink absorption layer such as PR101 as described because an ink absorption time for such a material tends to be longer than that for plain paper or high quality paper.

Now, arrangement of the discharge ports associated with recording will be described. Discharge port array groups (6*a*, 6*b*) in head chips each include two discharge port arrays 5 in which a plurality of discharge ports 16 are arranged at a regular pitch. A plurality of head chips 10*a* and 10*b* having the discharge port array groups are arranged in a shifted manner in a direction of movement of the head relative to the print material (the main scanning direction 101). In FIGS. 1A and 1B, two head chips only are arranged, but the invention may be applied when three or more head chips are arranged in a staggered manner or a step manner.

In the lower part of FIG. 1A, time-series formed dot patterns are shown when dots arranged perpendicularly to the main scanning direction are formed using the liquid discharge head 21 according to the embodiment. As in FIG. 8, dots are formed by liquid droplets discharged from the discharge ports on the discharge port line 1 in a time a. Dots are formed from the discharge ports placed on the discharge port line 2 in a time b, the discharge port line 3 in a time c, and the discharge port line 4 in a time d. Dots 31 formed in each time are diagonally shaded, and dots 32 formed before each time is shown by open circles.

At this time, in the embodiment, intervals between the times a and b and the times c and d correspond to a time of the relative movement between the liquid discharge head 21 and the print material 24 by the distance A between the two discharge ports arrays in each head chip 10 in the recording operation, and also an interval between the times b and c corresponds to a time of the relative movement between the liquid discharge head 21 and the print material 24 by the distance A between the adjacent discharge ports arrays in the adjacent head chips 10*a* and 10*b*.

Specifically, the distance A (a distance between the lines 1 and 2 and a distance between the lines 3 and 4) in a movement direction of discharge ports that form the adjacent dots among the discharge ports in one head chip (one discharge port array group) is equal to the distance A (a distance between the lines 2 and 3) in the movement direction of discharge ports that belong to adjacent head chips (adjacent discharge port array groups) and form the adjacent dots.

This causes an optical density of an overlapping portion of the dots formed by the discharge ports that belong to one head chip to be equal to an optical density of an overlapping portion of the dots formed by the discharge ports that belong to the adjacent head chips, thereby significantly reducing uneven optical densities in a connecting portion in a formed image.

Embodiment 2

FIG. 1B shows another application of the invention. Descriptions of the same parts as in Embodiment 1 will be omitted. In the embodiment, a distance A (a distance between lines 1 and 2 and a distance between lines 3 and 4) in a movement direction of discharge ports that form adjacent dots among discharge ports in one head chip (one discharge port array group) is different from a distance B (a distance between lines 2 and 3) in the movement direction of discharge ports that belong to adjacent head chips (adjacent discharge port array groups) and form adjacent dots. The distances A and B are set to distances corresponding to time differences such that an optical density of an overlapping portion of the dots formed by the discharge ports that belong to one head chip is equal to an optical density of an overlapping portion of the dots formed by the discharge ports that belong to the adjacent head chips. Specifically, as shown in FIG. 10, when a dot placement time difference is changed, a maximum optical density of the overlapping portion of the dots increases with increase in the dot placement time difference until the dot placement time difference of about 50 msec, and when the dot placement time difference becomes long enough, the maximum optical density becomes a certain value, 0.8 in the example in FIG. 10. The maximum optical density of the overlapping portion of the dots is the same between when a dot placement time difference x with the maximum optical density of 0.8 in an initial rising part is provided and when a dot placement time difference y with the maximum optical density of 0.8 after the maximum optical density is settled is provided. Thus, in the embodiment, the distance A is set to a distance such that the liquid discharge head 21 and the print material 24 move relative to each other in the time x in the recording operation, and the distance B is set to a distance such that the liquid discharge head 21 and the print material 24 move relative to each other in the time y.

In the study by the inventors, reduction in unevenness in images caused by the difference in the optical density was confirmed by setting the difference in the optical density to 2% or less. The time difference with the equal optical density in the invention refers to a range where the difference in the optical density is 2% or less.

According to this configuration, the dot placement time difference between the ink droplets onto pixel positions adjacent to each other perpendicularly to the main scanning direction 101 is the time difference x that is the distance between the times a and b and the times c and d, or the time difference y that is the distance between the times b and c, and for either dot placement time difference, the maximum optical density of the overlapping portion of the dots is the same. Thus, this configuration may reduce the uneven optical densities in a formed image. At this time, as compared with the distance A between the two discharge port arrays in each head chip 10, the distance B between the adjacent discharge port arrays in the adjacent head chips 10*a* and 10*b* is associated with adjustment of the arrangement of the head chip 10, and thus setting the distance B to be longer than the distance A facilitates manufacturing.

As described above, in the embodiment, the liquid discharge head 21 includes the plurality of head chips 10. Thus, a relatively long liquid discharge head 21 can be formed using relatively short head chips 10. At this time, unlike a case where a long full-line type head having a length corresponding to a width of the print material 24 is formed on one substrate, relatively short head chips 10 with high performance and high reliability can be manufactured and used at low costs and high yields without difficulty in manufacturing and maintenance. Thus, even a generally long liquid discharge head 21 may have high performance and high reliability.

Embodiment 3

Figure 11:
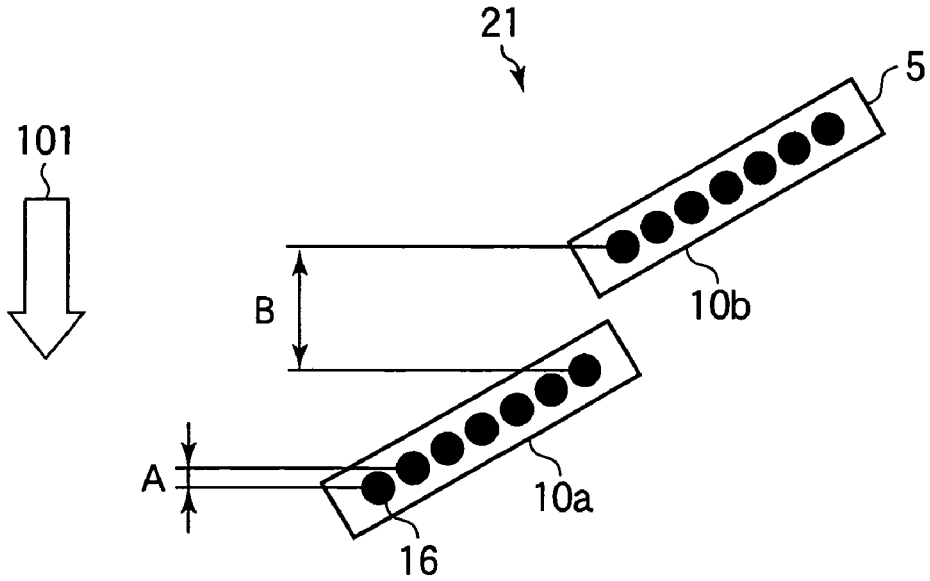
FIG. 11 is a schematic diagram of a liquid discharge head of an embodiment of the invention viewed from a side of a discharge port surface.

FIG. 11 shows a liquid discharge head according to Embodiment 3. Descriptions of the same parts as in Embodiment 1 will be omitted.

In a liquid discharge head 21 in FIG. 11, one discharge port array 5 only is formed in each of head chips 10*a* and 10*b*, and the discharge port array 5 is placed diagonally to a main scanning direction 101. Thus, a liquid is successively discharged from a discharge port at the front in the main scanning direction 101, and dots formed by adjacent discharge ports are formed with a time difference. A plurality of head chips are placed in a shifted manner in the main scanning direction 101 like the above described embodiments. Further, a pitch between adjacent discharge ports is narrow, and thus dots formed by the adjacent discharge ports overlap.

In order to reduce a difference in optical density value between the dots adjacent to each other and overlapping perpendicularly to the main scanning direction 101, a distance A in the main scanning direction 101 of discharge ports that form adjacent dots among discharge ports in one head chip and a distance B in a movement direction of discharge ports that belong to adjacent head chips and form adjacent dots may be adjusted.

A case where the distances A and B are the same is as in Embodiment 1, and a case where the distances A and B are different is as in Embodiment 2, thus descriptions thereof will be omitted.

In the embodiments, the small head chips having the discharge port array groups are placed in the shifted manner to form the generally long head, but a long chip may be used having a plurality of discharge port groups formed on a long substrate.

[Liquid Discharge System]

In the above embodiments, the configuration is shown using the liquid discharge head 21 of a liquid discharge system that uses the heater as the energy generating element to form flying a liquid droplet using thermal energy for recording among liquid discharge recording systems (ink jet recording systems).

For a typical configuration or principle, a basic principle disclosed in, for example, U.S. Pat. No. 4,723,129 and U.S. Pat. No. 4,740,796 is preferably used. This system may be applied to both a so-called on-demand type apparatus and a continuous type apparatus. In particular, for the on-demand type apparatus, at least one drive signal that provides a rapid temperature increase corresponding to recording information and exceeding nucleate boiling is applied to an electrothermal converting element placed correspondingly to a sheet or a channel holding a liquid (ink) to generate thermal energy in the electrothermal converting element, and cause film boiling in a heating surface of a recording head, thereby effectively forming a bubble in the liquid (ink) individually corresponding to the drive signal. The liquid (ink) is discharged through a discharge opening by growth and contraction of the bubble to form at least one droplet. The drive signal is preferably a pulse signal because the growth and contraction of the bubble is performed immediately and appropriately and the liquid (ink) can be discharged with satisfactory response. An appropriate pulse drive signal is as described in U.S. Pat. No. 4,463,359 and U.S. Pat. No. 4,345,262. Excellent recording can be performed when a condition is used described in U.S. Pat. No. 4,313,124 of an invention relating to a temperature increase rate of the heating surface.

As a configuration of the liquid discharge head, a configuration using U.S. Pat. No. 4,558,333 and U.S. Pat. No. 4,459,600 that disclose a configuration in which a heating part is placed in a bending area may be used besides a configuration including a combination of the discharge port, the channel and the electrothermal converting element (a linear liquid channel or a right-angle liquid channel) as disclosed in the above described patents.

In addition, a configuration may be used based on Japanese Patent Application Laid-Open No. 59-123670 that discloses a configuration in which slits common to a plurality of electrothermal converting elements are used as discharge portions of the electrothermal converting elements, or Japanese Patent Application Laid-Open No. 59-138461 that discloses a configuration in which an opening for absorbing a pressure wave of thermal energy corresponds to a discharge portion. Specifically, any type of liquid discharge head ensures efficient recording.

Either a liquid discharge head secured to an apparatus body or a changeable liquid discharge head that is fitted to an apparatus body to allow electric connection to the apparatus body and supply of ink from the apparatus body may be used. A cartridge type liquid discharge head having an ink tank formed integrally with a liquid discharge head may be used.

A bubble jet (BJ) type liquid discharge head using a heating element (heater) as an energy generating element is preferable because a large number of nozzle groups can be relatively easily achieved at low costs, but the liquid discharge head used for the liquid discharge recording apparatus according to the invention is not limited to this. For example, a charge control type head or a divergence control type head may be applied to a continuous type apparatus that continuously jets ink droplets to form grains, or a pressure control type head that discharges ink droplets from an orifice by mechanical vibration of a piezo vibration element may be applied to an on-demand type apparatus that discharges ink droplets on demand.

Recovery means of a liquid discharge head as described above and other auxiliary means may be preferably added as a configuration of the liquid discharge recording apparatus according to the invention in order to obtain more stable advantages of the invention. These means include capping means of a recording head, cleaning means, pressurization or suction means, auxiliary heating means for heating using an electrothermal converting element or a different heating element, or a combination thereof, and auxiliary discharge means for discharge other than recording.

As described above, according to the invention, the plurality of discharge port array groups are placed in the shifted manner in the relative movement direction between the head and the print material to form the generally long head for high speed operation. Further, when the adjacent overlapping dots are formed on the print material, the dots are formed with the dot placement time difference that provides the same optical density of the overlapping portion of the dots, thereby reducing uneven image densities caused by uneven optical densities and forming images with high quality and high reliability.

This application claims priority from Japanese Patent Application No. 2004-092978 filed Mar. 26, 2004, which is hereby incorporated by reference herein.

What is claimed is:

1. A liquid discharge recording method for forming a dot on a print material by discharging a liquid from a discharge port as a liquid droplet while moving a liquid discharge head including a discharge port array having the discharge ports that discharge the liquid arranged at a regular pitch relative to the print material, comprising the steps of;

forming adjacent dots having an overlapping portion perpendicularly to a movement direction of the print material with a time difference using a liquid discharge head having a plurality of discharge port array groups including at least one discharge port array placed in a shifted manner in the movement direction; and forming the adjacent dots with a time difference that provides the same optical density between an overlapping portion of dots formed by discharge ports that belong to one discharge port array group and an optical density of an overlapping portion of dots formed by discharge ports that belong to adjacent discharge port array groups.

2. A liquid discharge recording apparatus for forming a dot on a print material by discharging a liquid from a discharge port as a liquid droplet while moving a liquid discharge head including a discharge port array having the discharge ports that discharge the liquid arranged at a regular pitch relative to the print material, wherein adjacent dots having an overlapping portion perpendicularly to a movement direction of the print material are formed with a time difference, the liquid discharge head has a plurality of discharge port array groups including at least one discharge port array placed in a shifted manner in the movement direction, and a distance in the movement direction between discharge ports that belong to one discharge port array group and form adjacent dots and a distance in the movement direction between discharge ports that belong to adjacent discharge port array groups and form adjacent dots are set to a distance corresponding to the time difference that provides the same optical density between an overlapping portion of the dots formed by the discharge ports that belong to one discharge port array group and an optical density of an overlapping portion of the dots formed by the discharge ports that belong to the adjacent discharge port array groups.

3. The liquid discharge recording apparatus according to claim 2, wherein the distance in the movement direction between the discharge ports that belong to one discharge port array group and form the adjacent dots is equal to the distance in the movement direction between the discharge ports that belong to the adjacent discharge port array groups and form the adjacent dots.

4. The liquid discharge recording apparatus according to claim 2, wherein the distance in the movement direction between the discharge ports that belong to one discharge port array group and form the adjacent dots is different from the distance in the movement direction between the discharge ports that belong to the adjacent discharge port array groups and form the adjacent dots.

5. The liquid discharge recording apparatus according to claim 2, wherein the discharge port array groups are provided correspondingly to energy generating elements that generate energy used for discharging the liquid, respectively.

* * * * *

UNITED STATES PATENT AND TRADEMARK OFFICE

CERTIFICATE OF CORRECTION

PATENT NO. : 7,311,383 B2
APPLICATION NO. : 11/085126
DATED : December 25, 2007
INVENTOR(S) : Makoto Akahira et al.

It is certified that error appears in the above-identified patent and that said Letters Patent is hereby corrected as shown below:

COLUMN 1

Line 17, “work” should read --word--.

COLUMN 2

Line 4, “includes” should read --include--.

COLUMN 3

Line 5, “costs” should read --cost--.

COLUMN 4

Line 32, “picoliter” should read --picoliters--.

COLUMN 16

Line 10, “of;” should read --of:--;
Line 12, “perpendicularly” should read --perpendicular--; and
Line 30, “perpendicularly” should read --perpendicular--.

Signed and Sealed this

Twenty-second Day of July, 2008

JON W. DUDAS
*Director of the United States Patent and Trademark Office*